United States Patent [19]

Yoshida et al.

[11] Patent Number: 4,490,890

[45] Date of Patent: Jan. 1, 1985

[54] SEPARABLE SLIDE FASTENER

[75] Inventors: Hiroshi Yoshida; Shunji Akashi, both of Kurobe; Yoshio Matsuda, Nyuzen, all of Japan

[73] Assignee: Yoshida Kogyo K.K., Tokyo, Japan

[21] Appl. No.: 300,488

[22] Filed: Sep. 9, 1981

[30] Foreign Application Priority Data

Sep. 10, 1980 [JP] Japan ..... 55-125839

[51] Int. Cl.[3] ..... A44B 19/24

[52] U.S. Cl. ..... 24/434; 24/381; 24/395; 24/413

[58] Field of Search ..... 24/205.16 R, 205.16 C, 24/205.1 C, 205.16, 205 R, 205.11 F, 205.16 R, 205.11 C, 381, 392, 393, 394, 395, 396, 413, 434; 66/192, 193, 195

[56] References Cited

U.S. PATENT DOCUMENTS

| | | | |
|---|---|---|---|
| 2,098,338 | 11/1937 | Gilmore | 24/205.11 F |
| 2,652,705 | 9/1953 | Weinberg | 24/205.16 R |
| 2,701,222 | 2/1955 | Hetzel et al. | 154/116 |
| 3,030,684 | 4/1962 | Johns et al. | 24/205.11 F |
| 3,377,668 | 4/1968 | Carlile et al. | 24/205.11 F |
| 3,435,489 | 4/1969 | Morin | 24/205.11 F |
| 3,616,939 | 11/1971 | Potin | 24/205.11 F |
| 3,618,178 | 11/1971 | Hansen | 24/205.11 F |
| 3,752,718 | 8/1973 | Potin | 24/205.11 F |
| 3,983,721 | 10/1976 | Matsuda | 24/205.1 C |
| 4,001,922 | 1/1977 | Ward, Jr. | 24/205.11 F |
| 4,011,895 | 3/1977 | Dal Negro | 24/205.16 C |
| 4,014,190 | 3/1977 | Terada | 24/205.16 C |
| 4,047,402 | 9/1977 | Matsuda et al. | 66/192 |
| 4,056,868 | 11/1977 | Ebata | 66/195 |
| 4,075,874 | 2/1978 | Heimberger | 66/192 |
| 4,142,276 | 3/1979 | Heimberger | 24/205.16 C |
| 4,182,006 | 1/1980 | Yoshida | 24/205.16 C |
| 4,265,003 | 5/1981 | Matsuda | 24/205.16 R |
| 4,291,440 | 9/1981 | Yoshida | 24/205.16 R |

FOREIGN PATENT DOCUMENTS

| | | | |
|---|---|---|---|
| 827367 | 11/1969 | Canada | 24/47 |
| 1059377 | 6/1959 | Fed. Rep. of Germany | 24/205.11 F |
| 2046137 | 3/1972 | Fed. Rep. of Germany | 66/195 |
| 346608 | 2/1959 | Japan | 24/381 |
| 50-84205 | 7/1975 | Japan | 24/382 |
| 51-35709 | 11/1976 | Japan . | |
| 52-24161 | 6/1977 | Japan | 24/392 |
| 7102225 | 8/1971 | Netherlands | 24/205.11 F |
| 508372 | 6/1971 | Switzerland | 24/205.11 F |

*Primary Examiner*—Gene Mancene
*Assistant Examiner*—James Hakomaki
*Attorney, Agent, or Firm*—Hill, Van Santen, Steadman & Simpson

[57] ABSTRACT

A separable slide fastener has a pair of warp-knit stringer tapes each with a series of longitudinal openings for easy attachment to a knit fabric. Each of the stringer tapes includes a reinforcing body mounted on a lower end portion thereof and including a thin member and an endmost thick member both extending transversely across some of the tape opening, the thin member covering at least the endmost opening and the endmost thick body having a transverse portion contiguous to the thin member in the longitudinal direction of the stringer tape and extending about a portion of the thin member and the lower end portion of the stringer tape. A separable bottom end stop is injection-molded on the thin reinforcement member bonded to the stringer tape so as to form integrally therewith the thick reinforcement member.

6 Claims, 6 Drawing Figures

SEPARABLE SLIDE FASTENER

BACKGROUND OF THE INVENTION

1. Field of the Invention

The present invention relates to a separable slide fastener attachable to knit fabrics by means of knitting machines, linking machines, or the like. More particularly, the present invention is directed to improvements in and relating to such a separable slide fastener as proposed by the present inventors and described in the copending patent application Ser. No. 258,647, filed Apr. 29, 1981, entitled "SEPARABLE SLIDE FASTENER AND METHOD OF ATTACHING THE SAME TO KNIT FABRICS", and assigned to the present assignee.

SUMMARY OF THE INVENTION

A separable slide fastener comprises a reinforcement body mounted on a lower end of each warp-knit stringer tape and including a thin member and an endmost thick member both extending transversely across a longitudinal wale-free region in the stringer tape. The thin reinforcement member covers at least the lowermost one of equally spaced openings arranged in and along the wale-free region. The endmost thick member has a transverse portion contiguous to the thin member in the longitudinal direction of the stringer tape and wrapping a portion of the thin member and the lower end of the stringer tape. The separable slide fastener can be attached to a knit fabric by a chain of thread loops extending along the wale-free region of each stringer tape. The reinforcement body serves to allow endmost loops to fasten around the thin and thick reinforcement members with an increased degree of tightness.

It is an object of the invention to provide a separable slide fastener which is attachable to a knit fabric stably in position with an increased degree of tightness.

Another object of the present invention is to provide a separable slide fastener which is attachable to a knit fabric without becoming puckered or wavy.

Still another object of the invention is to provide a separable slide fastener having means for accommodating the longitudinal shrinkage of the stringer tapes thereof as it is attached to a knit fabric by rows of thread loops.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION OF THE PREFERRED EMBODIMENTS

Figure 1:
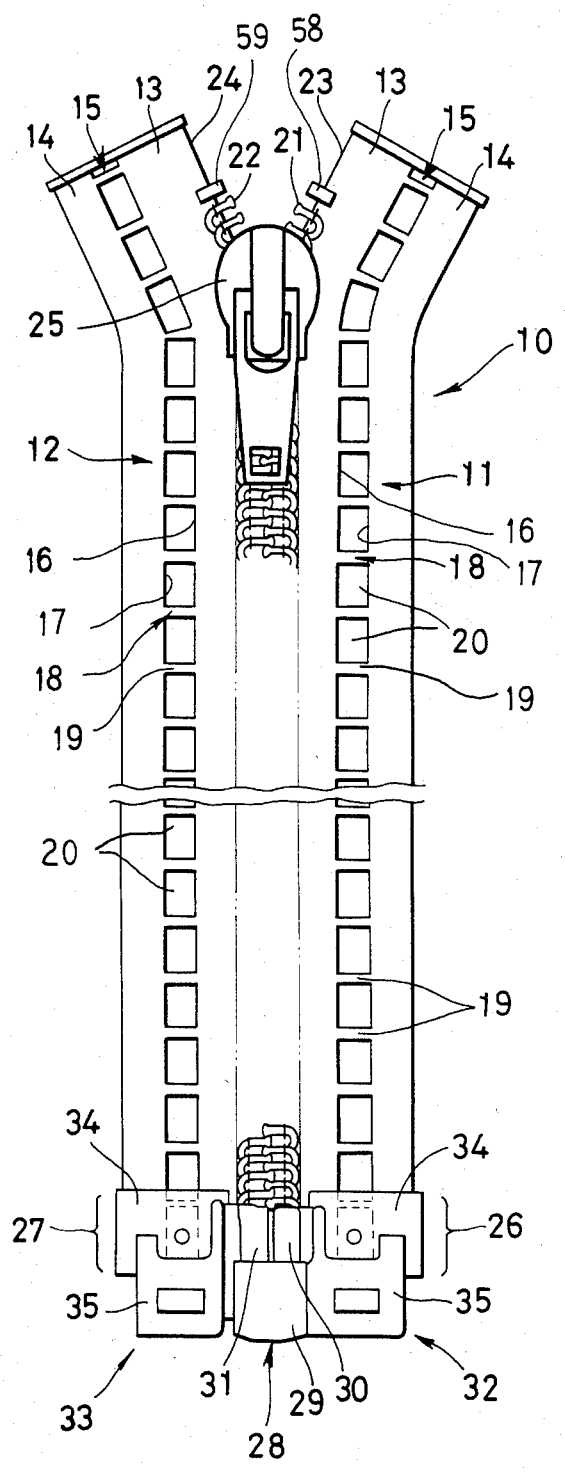
FIG. 1 is a fragmentary plan view of a separable slide fastener according to the present invention.

The principles of the present invention are particularly useful when embodied in a separable slide fastener such as shown in FIG. 1, generally indicated by the numeral 10. The separable slide fastener 10 comprises a pair of warp-knit stringer tapes 11,12 each including a pair of longitudinally extending, parallel warp-knit webs 13,14 and a longitudinal wale-free region 15 interposed between the webs 13,14. The warp-knit webs 13,14 include a pair of confronting marginal wales 16,17 interconnected transversely by a connecting thread 18 having ladder-like parallel portions 19 extending transversely across the wale-free region 15 in a direction substantially perpendicular to the marginal wales 16,17, thereby providing a plurality of rectangular openings 20 arranged longitudinally in and along the wale-free region 15.

A pair of rows of coupling elements 21,22, which are made preferably of filamentary material, is mounted on inner confronting beaded edges 23,24 of the warp-knit webs 13,13. A slider 25 (FIG. 1) is slidably mounted on the rows of coupling elements 21,22 for taking the latter into and out of interdigitating engagement to open and close the slide fastener 10. A pair of top end stops 58,59 is secured respectively to the opposed edges 23,24 of the webs 13,13 and located at an upper end of the stringer tapes 11,12 to prevent the slider 25 from moving off the rows of coupling elements 21,22 past the top end stops 58,59.

The stringer tapes 11,12 have respective lower end portions 26,27 on which is mounted a separable bottom end stop 28 including a box 29 and a box pin 30 extending therefrom, the box 29 and the box pin 30 being injection-molded on the end portion 26 of the tape 11, and a pin 31 injection molded on the end portion 27 of the tape 12, the pin 31 being insertable into the box 29. The separable bottom end stop 28 is located adjacent to the lower end of the rows of coupling elements 21,22. A pair of reinforcement bodies 32,33 is also mounted on the tape end portions 26,27, respectively and adjacent to the bottom end stop 28, each of the reinforcement bodies 32,33 comprising a thin member 34 and an endmost thick member 35 located below the thin member 34 as viewed in FIGS. 1 to 3.

Figure 6:
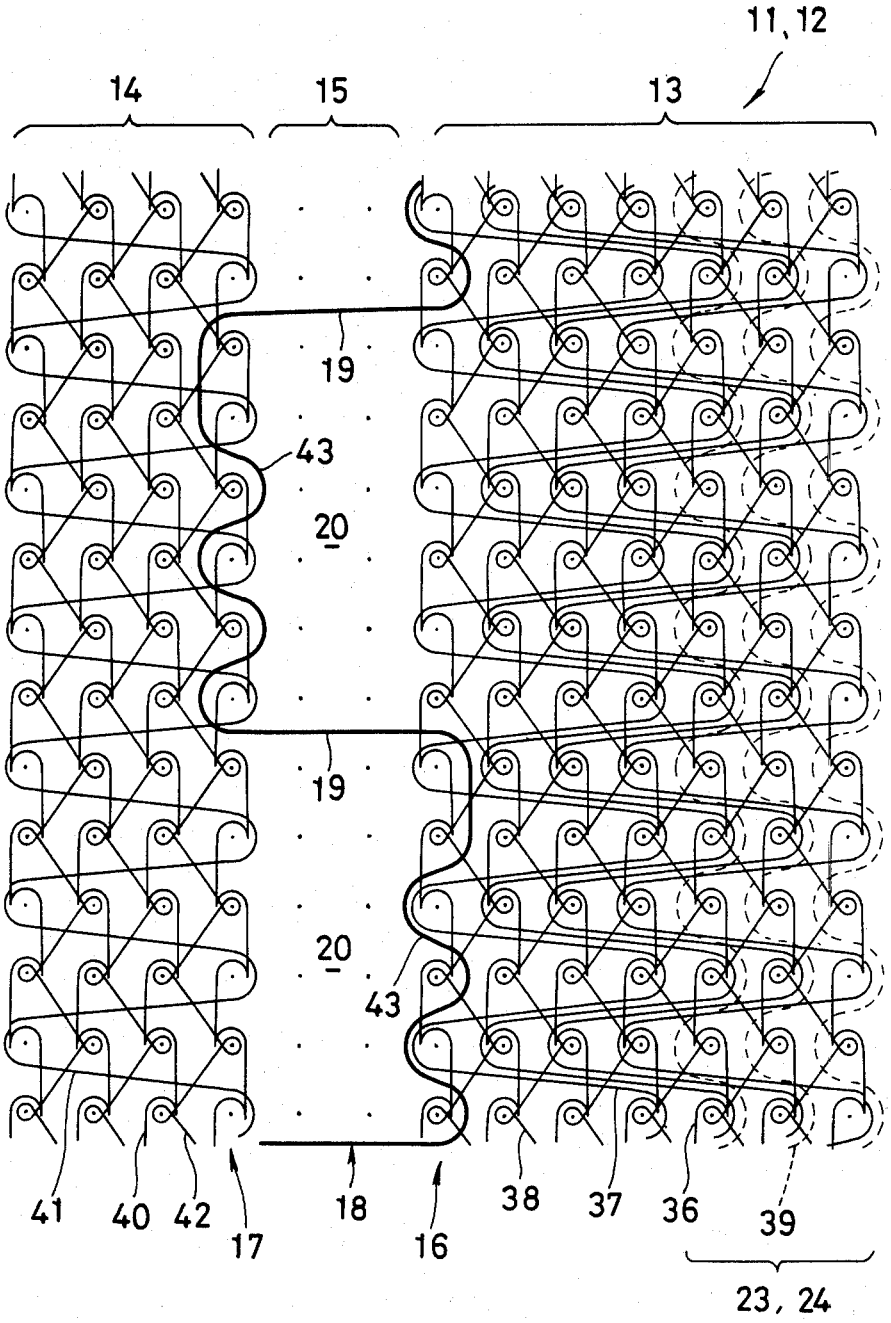
FIG. 6 is a point diagram showing lapping movements for a warp-knit stringer tape of the slide fastener shown in FIG. 1.

As shown in FIG. 6, each of the warp-knit webs 13,13 is composed of a first group of foundation threads 36 knitted as chain stitches in a pattern of 1-0/0-1, a second group of foundation threads 37 laid in coursewise in a pattern of 0-0/4-4, and a third group of foundation threads 38 knitted in a pattern of 1-2/1-0, the foundation threads 36–38 constituting a plurality of longitudinal wales juxtaposed across the web 13,13. The web 13 also includes a fourth group of three foundation threads 39 laid in warpwise in a pattern of 0-0/1-1 which reinforce the marginal edges 23,24 of the web 13 on which the coupling elements 21,22 are mounted.

Each of the warp-knit webs 14,14 is composed of a fifth group of foundation threads 40 knitted as chain stitches in a pattern of 1-0/0-1, a sixth foundation thread 41 laid in coursewise in a pattern of 0-0/4-4, and a seventh group of foundation threads 42 knitted in a pattern of 1-2/1-0, the foundation threads 40–42 constituting a plurality of longitudinal wales juxtaposed across the web 14. The web 14 is composed of four wales in the illustrated embodiment and is narrower than the web 13. The wale-free region 15 is devoid of two wales in the illustrated embodiment, but may be varied in width by selecting a suitable number of wales to be omitted therefrom, depending on the thickness of yarn of a knit fabric to which the stringer tapes 11,12 are to be attached and the thickness of knitting needles for use in such attachment. Such number is preferably selected from one to four.

The connecting thread 18 is laid across the wale-free region 15 in a pattern of 0-0/1-1/0-0/1-1/0-0/0-0/4-4/3-3/4-4/3-3/4-4/4-4 so that the connecting thread 18 also includes portions 43 laid longitudinally only in the marginal wales 16,17 of the webs 13,14 and cooperating with the parallel portions 19 to connect the wales 16,17 together. The connecting thread 18 is preferably made of twisted yarns which are several times thicker than the foundation threads 36–39, 40–42. The parallel portions 19 of the connecting thread 18 traverse the wale-free region 15 every six courses in the illustrated embodiment. However, they may skip fewer or more courses depending on the thickness of yarns of the knit fabric and the thickness of knitting needles.

Figure 2:
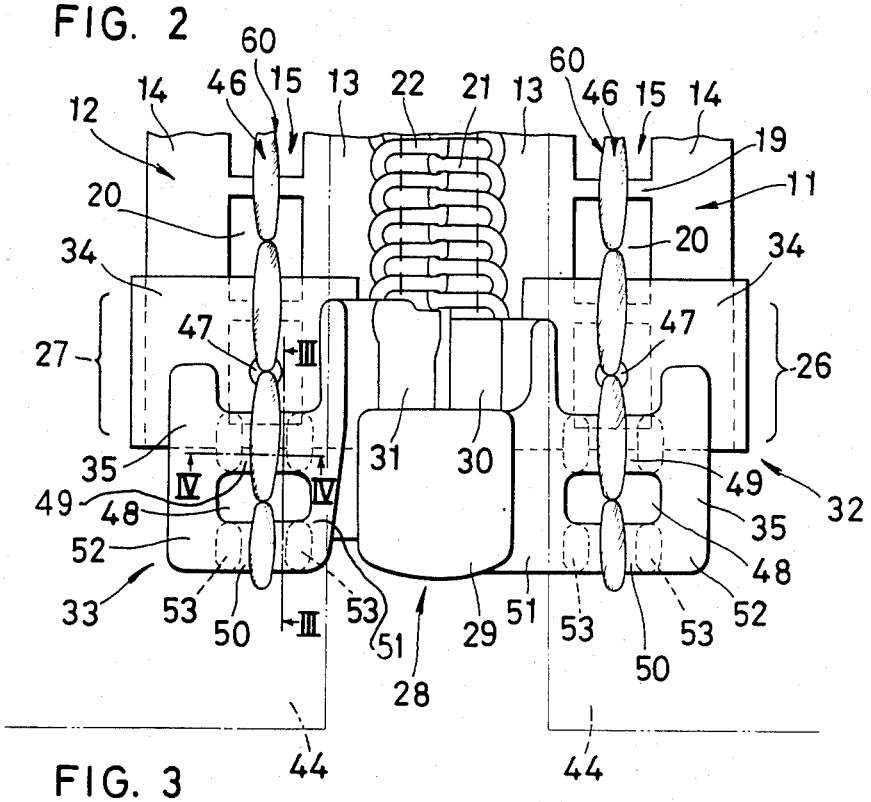
FIG. 2 is an enlarged fragmentary plan view of the slide fastener shown in FIG. 1 as it is attached to a knit fabric.
Figure 3:
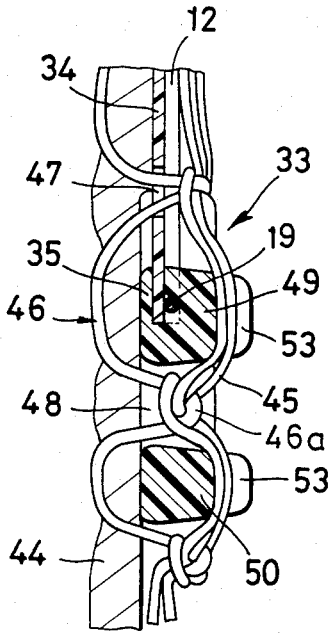
FIG. 3 is an enlarged cross-sectional view taken along line III—III of FIG. 2.
Figure 4:
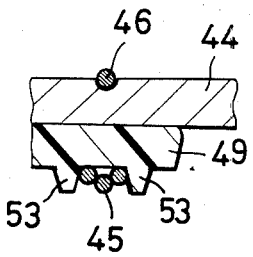
FIG. 4 is a cross-sectional view taken along line IV—IV of FIG. 2.

FIG. 2 and 3 shows a bottom end portion of the slide fastener 10 shown in FIG. 1, in which each stringer tape 11,12 is attached along one of confronting marginal edges of a knit fabric or fabrics 44 by a chain of thread loops 60 consisting of a row of loops or chain stitches 45 of wool yarn interlooped with a row of loops **46*a* of wool yarn 46 extending walewise through the knit fabric 44 and projecting through the openings 20 in the corresponding the stringer tape 11,12. Such linking operation can be carried out by an ordinary knitting machine or a linking machine or looper (not shown). Each of the thin reinforcement members 34 is in the form of a film of synthetic resin bonded to or otherwise mounted on the lower end portion 26,27 of one of the stringer tapes 11,12 and extends across the wale-free region 15 in the stringer tape 11,12 in overlying relation to the lowermost two of the transverse parallel portions 19,19 of the connecting thread 18. The reinforcement films 34,34 have a pair of holes 47,47, respectively, which are located at the lowermost openings 20,20 respectively in the stringer tapes 11,12, for enabling a knitting needle (not shown) to extend through the opening 20 and the hole 47 to interloop the yarn loop 46*a* with the stitches 45. The films 34,34 may be of a reduced thickness such that it is readily penetratable by the knitting needle when the latter is thrust in. The endmost thick reinforcement members 35,35 of synthetic resin are integrally injection-molded with the box pin 30 and the pin 31, respectively, and each of them is in the form of a centrally open rectangular frame having an opening 48. Each of the openings 48,48 is located beyond the corresponding tape end 26,27 in alignment with one of the rows of openings 20 for receiving therein an interstitch of the yarn loops 46*a* and the chain stitches 45. Each of the endmost thick member 35 has a pair of upper and lower transverse portions 49,50 interconnected at their respective opposite ends by a pair of longitudinal portions 51,52 projecting away from the tape end portion 26,27, the upper transverse portion 49 being contiguous to the thin reinforcement member 34 in the longitudinal direction of the stringer tape 11,12 and extending about the lower-most transverse thread portion 19 and a portion of the thin reinforcement member 34. With this arrangement, each of the reinforcement bodies 32,33 serves to stabilize the lower end portion of the slide fastener 10 on the knit fabric 44 and also to allow succeeding the endmost three loops of the chain of thread loops 60 to be fastened tightly around the thin reinforcement member 34 and the transverse portions 49,50 of the endmost thick reinforcement member 35, respectively, with the result that the slide fastener 10 is secured stably in position to the knit fabric 44 with an increased degree of tightness against loosening of the endmost thread loops 60. Furthermore, the thin reinforcement members 34,34 serve to accommodate the longitudinal shrinkage of the respective stringer tapes caused by tightly binding the chain stitches 45 and the yarn loop 46*a* together around the thick reinforcement members 35 at the lower end of the slide fastener 10 and hence prevent the transverse thread portions 19 from being adversely affected by such a tape shrinkage. Thus, the slide fastener 10 attached to the knit fabric 44** is free from puckering or waving.

Figure 5:
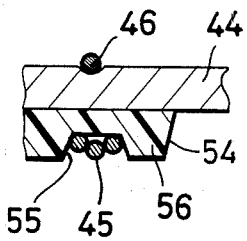
FIG. 5 is a view similar to FIG. 4, showing a modification.

Each transverse portion 49,50 has on its back side a pair of spaced ridges 53,53 extending longitudinally along the wale-free region 15 in one of the stringer tapes 11,12 for receiving therebetween the chain stitches 45 of the thread loops 60 to protect the same against lateral displacement and rupture at the stringer tape ends 26,27 which are subjected to frequent stress due to repeated manual coupling and uncoupling of the bottom end stop 28. Alternately, as shown in FIG. 5 each endmost thick member 54 may be provided with a groove 55 recessed therein to extend longitudinally through an upper and a lower transverse portion thereof 56 (only upper one being shown) for receiving therein the chain stitches 45.

Although various minor modifications might be suggested by those versed in the art, it should be understood that we wish to embody within the scope of the patent warranted hereon, all such embodiments as reasonably and properly come within the scope of our contribution to the art.

What is claimed is:

1. A separable slide fastener comprising:

(a) a pair of warp-knit stringer tapes each including a pair of longitudinal warp-knit webs spaced transversely from each other with a longitudinal wale-free region therebetween, and a connecting thread interconnecting said webs and having substantially parallel portions extending transversely across said wale-free region and spaced longitudinally at an equal interval, thereby defining a plurality of substantially rectangular openings longitudinally in and along said wale-free region;

(b) a pair of rows of coupling elements mounted on inner confronting longitudinal edges of said stringer tapes remotely from said wale-free region, respectively;

(c) a slider movable along said pair of rows of coupling elements for engaging and disengaging the latter;

(d) a separable bottom end stop comprising a box and a box pin extending therefrom, which are mounted on one of said warp-knit stringer tapes at one end thereof, and a pin mounted on the other stringer tape at one end thereof and insertable into said box; and (e) a reinforcing body mounted on each of said stringer tapes at said one end thereof and adjacent to said separable end stop and including a thin member and an endmost thick member both extending transversely across said wale-free region, said thin member covering at least one of said openings defined by the endmost two of said parallel portions, and said endmost thick region having a transverse portion contiguous to said thin member in the longitudinal direction of said stringer tape and extending about a portion of said thin member and said one end of said stringer tape.

2. A separable slide fastener according to claim 1, said thin member comprising a film of synthetic resin bonded to said stringer tape.

3. A separable slide fastener according to claim 1, said thin member having a hole therein located at said at least one opening.

4. A separable slide fastener according to claim 1, said endmost thick member being integrally injection molded with said separable bottom end stop.

5. A separable slide fastener according to claim 1, said endmost thick member further having an additional transverse portion extending parallel to said first portion and spaced from said one end of said stringer tape.

6. A separable slide fastener according to claim 1, said endmost thick member being in the form of a centrally open rectangular frame having an opening located beyond said one end of said stringer tape in longitudinal alignment with said wale-free region.

* * * * *